United States Patent [19]

Bousaid

[11] Patent Number: 4,729,431

[45] Date of Patent: Mar. 8, 1988

[54] OIL RECOVERY BY QUENCHED IN SITU COMBUSTION

[75] Inventor: Issam S. Bousaid, Houston, Tex.

[73] Assignee: Texaco Inc., White Plains, N.Y.

[21] Appl. No.: 947,298

[22] Filed: Dec. 29, 1986

[51] Int. Cl.[4] ..... E21B 43/243

[52] U.S. Cl. ..... 166/261

[58] Field of Search ..... 166/261, 256, 263

[56] References Cited

U.S. PATENT DOCUMENTS

| | | | |
|---|---|---|---|
| 3,024,841 | 3/1962 | Willman | 166/261 |
| 3,064,728 | 11/1962 | Gould | 166/261 |
| 3,163,216 | 12/1964 | Grekel | 166/261 |
| 3,376,929 | 4/1968 | Hagedorn | 166/261 |
| 3,448,807 | 6/1969 | Strickland, Jr. | 166/261 X |
| 4,436,344 | 3/1984 | Forgac et al. | 166/261 X |
| 4,532,991 | 8/1985 | Hoekstro et al. | 166/261 |

*Primary Examiner*—Stephen J. Novosad

*Attorney, Agent, or Firm*—Jack H. Park; Kenneth R. Priem; Harold J. Delhommer

[57] ABSTRACT

The invention is an in situ combustion method wherein a combustion front is quenched by the injection of water and reignited after quenching by the injection of an oxygen-containing gas and any necessary heat. The quenching of the combustion drive is repeated several times.

14 Claims, 1 Drawing Figure

OIL RECOVERY BY QUENCHED IN SITU COMBUSTION

BACKGROUND OF THE INVENTION

The invention is a process for recovering hydrocarbons from an underground hydrocarbon formation. More particularly, the invention relates to a method of employed in situ combustion wherein the combustion front is quenched with water and reignited in order to shorten the flood life and improve the economics of fireflooding.

It is well recognized that primary hydrocarbon recovery techniques may recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the formation. Waterflooding and steamflooding have proven to be the most successful oil recovery techniques yet employed in commercial practice. Successes have also been achieved with in situ combustion processes.

An in situ combustion process requires the injection of sufficient oxygen-containing gas such as air to support and sustain combustion of the hydrocarbons in the reservoir. When the flow of the oxygen-containing gas in the reservoir is large enough, combustion will occur, either spontaneously or from an external heat source such as a downhole heater. A portion of the oil is burned as fuel at the high temperature front which proceeds slowly through the reservoir, breaking down the oil into various components, vaporizing and pushing the oil components ahead of the burning regions through the reservoir to the production wells.

Several methods have been suggested to improve in situ combustion drives. The most effective of these has been the method of wet combustion. In this case, a combustion drive is converted into wet combustion by the co-injection or alternate injection of water along with the oxygen-containing gas for combustion. A portion of the water that is injected flashes ahead of the combustion front to form a larger steam plateau which helps provide for greater displacement and oil recovery than a dry combustion process. Wet combustion offers the advantages of higher oil recovery, higher combustion front velocity, and lower fuel and air requirements than dry combustion.

Several combustion methods have been disclosed in which an in situ combustion process has been quenched as a floodout stage by the injection of water near the end of combustion. These processes do not disclose the quenching of a combustion drive and refrain from such a step prior to reaching the end of the combustion phase of a method. No mention is made of the reignition of a quenched combustion drive during, or after combustion.

U.S. Pat. Nos. 3,991,828 and 4,059,152 disclose methods for recovering viscous crude by first injecting superheated steam, initiating a combustion drive followed by wet combustion, and concluding with the injection of water when the wet combustion front reaches the production wells. U.S. Pat. No. 4,495,994 discloses a process with the injection of high quality steam, followed by the injection of steam of a decreasing quality, followed by wet in situ combustion, and finally, 100% water injection without air for combustion floodout near the production wells. U.S. Pat. No. 3,150,715 also discloses a wet in situ combustion process wherein injection of air is discontinued while water injection is continued, but only once the combustion front has reached production wells.

Although it is generally considered desirable to operate a wet combustion drive at a high water to air ratio, it is considered undesirable to quench the combustion front prior to reaching the area of the production wells. The literature constantly warns against injecting an excesive quantity of water and extinguishing the combustion front. This may be because of ignition problems which have been experienced in some combustion projects in the field.

SUMMARY OF THE INVENTION

The invention is an in situ combustion method wherein a combustion front is quenched by the injection of water and reignited after quenching by the injection of an oxygen-containing gas and any necessary heat. Preferably, the quenching of the combustion drive is repeated several times for maximum benefits prior to the combustion front reaching the production well. The quenching and reignition of a combustion front offers substantial advantages over other combustion drives in combustion front velocity and fuel and air requirements.

DETAILED DESCRIPTION

Figure 1:
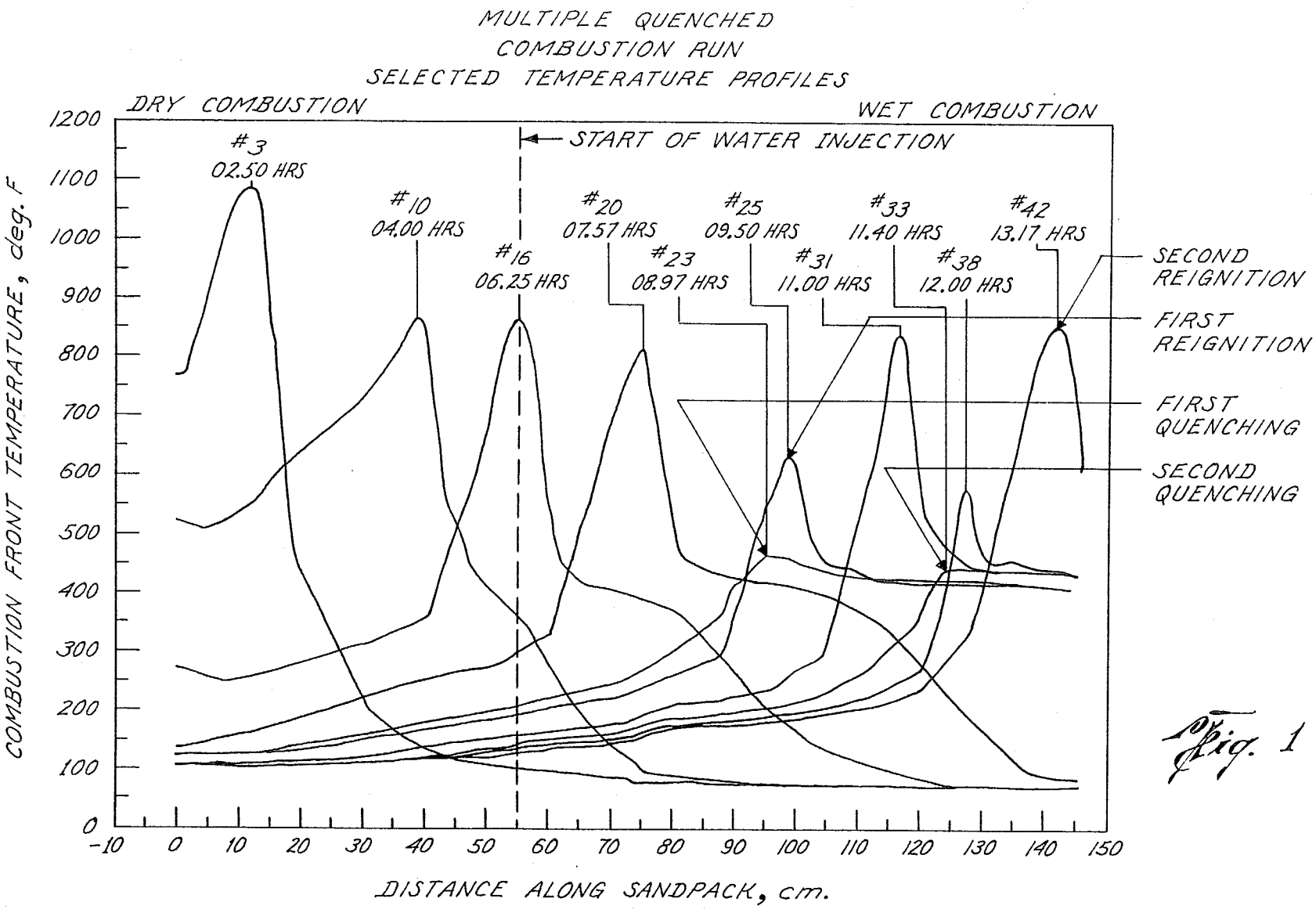
FIG. 1 is a graph of combustion front temperature versus the sand pack distance a combustion front traveled in a test cell. The graph illustrates several temperature profiles taken at different times including a first quenching of the front, a first reignition of the front, a second quenching, and a second reignition of the front.

The invention process is based on quenching a combustion front by water injection and reigniting the combustion front after the quenched cycle. The quenching and reignition cycle is preferably repeated several times to achieve the full advantages of the process. The optimum number of repetitions will depend upon formation characteristics, well spacing and the performance of previous cycles.

The quenched combustion process has the advantage of generating a fast moving thermal front through an oil formation. It offers substantial advantages in velocity and operating characteristics over wet combustion. The thermal response is more rapid with oil banked and produced at increased rates. Fuel and air requirements are decreased. The flood life is shortened, substantially reducing operating costs.

The literature has consistently shown that the injection of water with air improves the in situ combustion process by lowering fuel and air requirements and increasing front velocity. Test results have shown that both fuel and air are reduced up to 20% at high water-to-air ratios (WAR), when compared to dry combustion (WAR=0). Because of its high heat capacity, water scavenges most of the generated heat stored behind the burning front and carries superheated steam over the front to the steam plateau region where the oil bank is found in front of the combustion front. The water injected may be cold water, hot water or steam.

The combustion front velocity increases with increases in WAR. But at very high WAR values, the water zone approaches the burning zone from behind the front. Continued water injection will quench the combustion zone, reducing the front to a steam or hot water region.

Upon quenching of the combustion front with water, temperatures may be reduced from about 800° F. or more to about 500° F. or less. Upon quenching the burning front, a larger steam plateau is formed ahead of the front. The thermal shock of the quenching of the front pushes the oil further forward towards the production wells to yield a higher production rate. When repeated several times, the combustion process transfers heat from the burn front to the steam zone. The process is considerably improved with rapid frontal advances up to 100% greater than conventional firefloods.

Contrary to common belief, it has been discovered that combustion fronts which have been extinguished can be reignited. In most cases, reignition will require nothing more than the injection of an oxygen-containing gas. In some cases, additional external heat or higher air or oxygen content gas flux may be required. Such heat may be provided by the injection of steam, or by a temporary increase in the oxygen rate.

In general, hydrocarbon reservoirs are superbly insulated. They loose heat very slowly. Thus, even when the combustion front has been extinguished by an excess of injected water, or the injection of too little air to support combustion, the reservoir will retain sufficient heat for reignition, for several weeks or even months. This is particularly true for the area of the reservoir in which the combustion front was quenched.

To practice the combustion drive method in an underground hydrocarbon formation penetrated by at least one injection well and one production well, the oil formation is first ignited to form a combustion front by injecting an oxygen-containing gas and heat through an injection well. Air is the oxygen-containing gas of choice because of its ready availability and cost, but other gas mixtures containing oxygen may be employed to support combustion. Provided sufficient temperatures exist in the reservoir, ignition will follow automatically after the injection of a sufficient quantity of oxygen-containing gas into the reservoir.

Most hydrocarbon reservoirs susceptible to in situ combustion must first be heated to initiate the combustion drive. An igniter, many types of which are well known, is preferably used to initiate the combustion along with the injection of air. After the igniter has raised the formation temperature in the immediate vicinity of the wellbore to ignite the formation, the igniter is removed.

A convenient ignition method in the field uses a steam slug at 450° to 500° F. prior to air injection. The steam volume injected at the sandface is approximately 20 to 30 barrels of cold water equivalent steam per foot of oil pay thickness. This ignition technique is best suited for shallow reservoirs up to 1000 feet deep. A larger steam volume is used for deeper reservoirs in order to compensate for the wellbore heat losses prior to the injection phase. In cases where the formation temperature is high enough, the injection of a sufficient quantity of air may be enough to spontaneously ignite the oil formation and establish a burning zone without the use of an igniter.

Once combustion has been initiated, an adequate supply of the oxygen-containing gas is important. Once the combustion front has propagated a sufficient distance away from the wellbore to achieve a stabilized burn, it is preferred, but not essential, to convert the dry combustion drive to a wet in situ combustion process. This may be done by injecting water concurrently or alternately with the oxygen-containing gas through the injection well or wells. It is preferred to initially inject water at a WAR of about 100 to about 400 bbls/MMCF$_{air}$. After the wet combustion has stabilized, the WAR can be increased.

The combustion front is quenched by injecting a sufficient amount of water into the formation through the injection well to lower its temperature. This may be done by gradually increasing the WAR to a point where the front will quench, or injecting a large slug of water, or injecting water with reduced injection of air.

Since hydrocarbon reservoirs retain heat very well, it is believed that a front could be extinguished for several days, or weeks or longer and be spontaneously reignited upon the injection of an oxygen-containing gas alone. If a longer waiting period between quenching and reignition is employed, or if the quenching lowers the temperature of the former front by too great a degree, it may be necessary to supply heat to the reservoir along with large increases in the oxygen-containing gas rate for reignition. This is most readily done with the injection of superheated steam. The steam and oxygen-containing gas can be co-injected or injected in alternate slugs.

The process of quenching and reignition is preferably continued through a multiple number of cycles in order to maximize the advantages of the invention process. During the quenching process, the water bank formed behind the burning zone propels through and jumps ahead of the former combustion front causing a leap frog effect. This step of the process substantially raises the velocity of the front and provides an extra drive through the reservoir for increased production. The steam plateau also grows in size extending into the oil bank with the quench and subsequent reignition of the combustion drive. A larger steam plateau results in greater displacement efficiency with a larger hydrocarbon recovery at an earlier time.

The combustion front may also be quenched by cutting back on air injection instead of increasing the WAR. But reducing or stopping air injection is not as efficient as increasing water injection for quenching the front while maintianing a constant oxygen rate. Cutting back on air injection may be likened to choking the front, instead of quenching the front. When air is cut off, the front will quit moving due to lack of oxygen, hydrocarbon production at the production wells will drop or cease, and the all important project life will increase. The best method for quenching the front is by a high or an excess WAR. This gives the advantages of wet combustion, a constantly moving front, and the high velocity effect of the water quench. When a front is choked by cutting back on air, the front temperature does not decrease much. The front just becomes stationary.

For reignition, it is desirable to cease water injection in order to reignite the front more rapidly with the injection of an oxygen-containing gas alone. However, it may not be necessary to completely cease water injection. In some cases, it may be sufficient to decrease the amount of water to a sufficient degree while increasing the oxygen rate to allow for reignition. But reignition occurs sooner and is more efficient by completely stopping water injection. Reignition will usually take place a distance from the previous burning front, thus allowing the combustion drive to continue at an accelerated rate.

It is also preferred to wait a short time after reignition before beginning water injection again in order to allow the combustion front to restabilize. But when the front has stabilized after reignition, it is desirable once again to convert the combustion drive to wet combustion by the injection of water, and to gradually increase the WAR beyond that for quenching until the front is actually quenched once again. The optimum time delay for reignition and that for quenching to occur upon resuming a high WAR are determined from laboratory and field tests.

Because of the additional high velocity the combustion front gains after each quench, it becomes more difficult to quench the front another time. The WAR necessary to quench the front will normally be greater than the WAR needed to quench the front the previous time. Preferably, a WAR of at least 600 barrels of water per MMCF of air will be employed for additional quenches. It may also be desirable to increase injection pressure during quenching and to decrease injection pressure during reignition.

Optionally, a light hydrocarbon gas such as methane, ethane, propane, or butane may be co-injected with the oxygen-containing gas and, optionally, water, to further improve the viscosity of the underground hydrocarbons. Carbon dioxide may also be injected along with the oxygen-containing gas to improve formation injectivity, the viscosity of the underground hydrocarbons, and the overall efficiency of the combustion drive. The carbon dioxide should be injected in the amount of 0.02 to about 0.1 volumes of carbon dioxide to volumes of oxygen in the oxygen-containing gas. Care must be taken to inject sufficient air and not suffocate the combustion front with carbon dioxide.

The multiple quenching and reignition of the hydrocarbon reservoir has obvious economic advantages. The average combustion front velocity substantially increases, which increases the oil production rate and reduces the life of the flood. Fuel consumption in the reservoir and air compression costs at the surface are also reduced. When combined, these factors can reduce investments and operating costs of the project up to one half that required for conventional firefloods.

The following examples further illustrate the novel combustion front quenching and reignition method of the present invention. These examples are given by way of illustration and not as limitations on the scope of the invention. Thus, it should be understood that the steps and materials employed in the instant method may be varied to achieve similar results within the scope of the invention.

EXAMPLES 1–2

Two combustion runs were performed in a 150 cm insulated combustion cell in the laboratory. The cell was filled with a core containing a 21° API crude oil.

In Example 1, a dry combustion was ignited and allowed to proceed through the combustion tube. Water injection was begun after the combustion front had traveled approximately 47 cm down 150 cm combustion tube. From a temperature in excess of 700° F., cold water was injected until the front was quenched to about 470° F. at a distance of about 105 cm. The heated oil sand was then quickly reignited to 640° F. at about 115 cm by resuming air injection alone. The combustion front continued to propagate to the end of the combustion tube.

In Example 2, a dry combustion front was initiated at the beginning of the cell and wet combustion was started with hot water and steam at 41 cm into the cell. The burning front was quenched from a temperature of about 800° F. to 385° F. at 96 cm from the sand face by the injection of hot water. Reignition was accomplished by air injection alone. Within 1 hour, a 710° F. combustion front emerged at a distance of 101 cm from the sand face. The Example 1 combustion drive was reignited by air injection alone from a cold water quenched temperature of 470° F. The Example 2 fireflood was quenched with hot water and reignited from a quenched temperature of 385° F. by the injection of air alone.

EXAMPLE 3

The same 150 cm insulated combustion tube used in Examples 1 and 2 was employed for Example 3. This run featured two quenchings and two reignitions within the 150 cm length of the core. The core was taken from an East Texas area that is considered susceptible to combustion flooding. The oil contained therein had an API gravity of about 18° and the core had the characteristics set forth at the bottom of Table 1.

In Example 3, a dry combustion front progressed 55 cm into the cell at which time cold water was coinjected with air. A high WAR quenched the combustion front of about 864° F. to the 470° F. hot water region as shown in FIG. 1. The first reignition was accomplished by air injection alone within 30 minutes after quenching the front at 94.7 cm. The second quenching occurred at 124.7 cm using a higher WAR. The front temperature of 809° F. was reduced to 445° F. The front was once again reignited downstream at about 130 cm.

The process of quenching and reignition can be a rapid phenomenon with quenching being more difficult the second time. The combustion drive process becomes more efficient consuming less fuel and less oxygen or air. The burn front velocity increased significantly due to the leap frog effect during quenching. Less fuel was oxidized as more residual fuel was found on the sand grains. Specific data for the multiple quenched and reignited fireflood is shown in Table 1.

The quenched combustion drive had a favorable effect on the produced oil. The oil recovered was upgraded significantly by in situ thermal cracking and distillation of the in situ oil. This oil upgrading is comparable to that produced by the reverse combustion process. Produced oil viscosities decreased from an initial 2400 cp to less than 100 cp for the quenched combustion flood compared to 132 to 707 cp oil produced in wet combustion tests.

TABLE 1

| | Multiple Quenched Combustion Core Flood | | | | |
|---|---|---|---|---|---|
| | | Multiple Wet-Quenched-Reignition Period | | | |
| Combustion Type | Dry | Wet & Quenched | | Wet & Quenched | |
| Water-Air Ratio (in Bbls/MMCF$_{air}$) | 0 | 603 | 580 | 596 | 596 |
| Run Time Interval (hrs.) | 3.55–4.5 | 6.25 | 8.97 | 10.5 | 11.4 |

TABLE 1-continued

| Multiple Quenched Combustion Core Flood | | | | | |
|---|---|---|---|---|---|
| | Multiple Wet-Quenched-Reignition Period | | | | |
| Combustion Type | Dry | Wet & Quenched | | Wet & Quenched | |
| Distance Swept (cm) | 33–43.5 | 6.25 | 94.7 | 108.7 | 124.7 |
| Air Flux (SCF/(hr.-ft.$^2$)) | 96 | 103 | 107 | 104 | 104 |
| Front Temperature (°F.) | 849 | 864 | 470 | 809 | 445 |
| Reignition Temp. (°F.) | | First = 799° | | Second = 822° F. | |
| Front Velocity (cm/hr.) | 10.5 | 13.4 | 16.1 | 14.0 | 19.2 |
| Fuel Consumed (lb/ft.$^3$) | 1.71 | 1.45 | 1.10 | 1.37 | 0.89 |
| Air Requirement (SCF/ft.$^3$) | 278 | 233 | 203 | 227 | 164 |
| Oxygen Utiliz. Efficiency (%) | 99 | 100 | 100 | 99 | 100 |
| Residual Fuel on Sand (lb/.ft.$^3$) | 0 | 0 | 0.89 | 1.10 | 1.16 |
| Air to Oil Ratio (MCF/STB) | 12.2 | 10.3 | 8.9 | 10.0 | 7.2 |
| Oil Viscosity @ 76° F. (cp) | | 97–36 | | 76–44 | |

| | |
|---|---|
| Oil Recovery (%) | 75.9 |
| Water to Oil Ratio Produced | 2.5 |
| Atomic H/C Ratio Burned | 2.42 |
| Air Injection Pressure (Psig) | 500 |

The core used for the multiple quenched combustion run of Example 3 (Table 1) had these characteristics.

| | |
|---|---|
| $S_{oi}$ (%) | 41.0 |
| $S_{wi}$ (%) | 21.1 |
| $\phi$ (%) | 41.0 |
| $K_{gas}$ (md) | 1646 |

Other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. An in situ combustion method of recovery hydrocarbons from an underground hydrocarbon formation penetrated by at least one injection well and at least one production well, which comprises:

igniting the formation to form a combustion front by injecting oxygen-containing gas and heat into a hydrocarbon formation through an injection well;

quenching the combustion front by injecting a sufficient amount of water into the formation through the injection well;

reigniting the combustion front at a location farther away from the injection well than the previously quenched combustion front by injecting an oxygen-containing gas into the formation through the injection well; and recovering hydrocarbons and other fluids at a production well.

2. An in situ combustion method of recovery hydrocarbons from an underground hydrocarbon formation penetrated by at least one injection well and at least one production well, which comprises:

igniting the formation to form a combustion front by injecting oxygen-containing gas and heat into a hydrocarbon formation through an injection well;

quenching the combustion front by injecting a sufficient amount of water into the formation through the injection well;

reigniting the combustion front at a location farther away from the injection well than the previously quenched combustion front by injecting an oxygen-containing gas into the formation through the injection well;

quenching the combustion front again by injecting a sufficient amount of water into the formation through the injection well; and recovering hydrocarbons and other fluids at a production well.

3. The method of claim 2, further comprising converting the combustion to wet in situ combustion prior to first quenching the combustion front.

4. The method of claim 2, wherein the oxygen-containing gas is air.

5. The method of claim 2, further comprising converting the combustion to wet in situ combustion after the combustion front has been reignited.

6. The method of claim 2, further comprising injecting heat along with an oxygen-containing gas to reignite the combustion front after the combustion front has been quenched.

7. The method of claim 6, wherein heat is injected into the formation by the injection of hot water.

8. The method of claim 6, wherein heat is injected into the formation by the injection of steam.

9. The method of claim 2, further comprising injecting carbon dioxide with the oxygen-containing gas in the ratio of about 0.02 to about 0.1 volumes of carbon dioxide to volumes of oxygen in the oxygen-containing gas.

10. The method of claim 2, further comprising the injection of a light hydrocarbon solvent along with the injection of the oxygen-containing gas during combustion.

11. The method of claim 2, wherein the combustion front is quenched a second time with a water to air ratio of at least 600 barrels of water per MMCF of air.

12. The method of claim 2, further comprising increasing injection pressure during quenching.

13. The method of claim 2, further comprising decreasing injection pressure during reignition.

14. An in situ combustion method of recovering hydrocarbons from an underground hydrocarbon formation penetrated by at least one injection well and at least one production well, which comprises:

igniting the formation to form a combustion front by injecting air and heat into a hydrocarbon formation through an injection well;

injecting water with the air to form a wet combustion front in a water to air ratio of about 100 to about 400 barrels of water per MMCF air;

quenching the combustion front by increasing the injected water to air ratio until sufficient water has been injected to quench the front;

ceasing the injection of water;

reigniting the combustion front at a location farther away from the injection well than the previously quenched combustion front by injecting air into the formation through the injection well;

injecting water with the air to form a wet combustion front in a water to air ratio of about 100 to about 400 barrels of water per MMCF air;

quenching the combustion front again by increasing the injected water to air ratio until sufficient water has been injected to quench the front; and recovering hydrocarbons and other fluids at a production well.

* * * * *